US006557643B1

(12) United States Patent
Hall et al.

(10) Patent No.: US 6,557,643 B1
(45) Date of Patent: May 6, 2003

(54) ROD HANGER AND CLAMP ASSEMBLY

(75) Inventors: Craig Melvin Hall, Lashburn (CA); Richard Dale Stephens, Lloydminster (CA)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/710,167

(22) Filed: Nov. 10, 2000

(51) Int. Cl.[7] ..... E21B 19/02

(52) U.S. Cl. ..... 166/382; 166/68.5; 166/75.14; 166/94.1; 248/541

(58) Field of Search ..... 166/68.5, 85.1, 166/75.14, 96.1, 94.1, 85.5, 382, 379, 78.1; 248/541, 74.1, 411, 413, 527; 175/325.7; 285/123.12, 123.4

(56) References Cited

U.S. PATENT DOCUMENTS

| | | | | | |
|---|---|---|---|---|---|
| 732,925 | A | * | 7/1903 | Decker | 166/95.1 |
| 1,048,705 | A | | 12/1912 | Klefman | |
| 3,679,238 | A | | 7/1972 | Putch | 285/123.12 |
| 3,690,381 | A | | 9/1972 | Slator et al. | 166/384 |
| 4,552,213 | A | * | 11/1985 | Boyd et al. | 166/88.4 |
| 4,576,501 | A | * | 3/1986 | McConnell | 403/59 |
| 4,791,986 | A | * | 12/1988 | Vallet | 166/85.1 |
| 4,836,289 | A | * | 6/1989 | Young | 166/379 |
| 4,898,238 | A | | 2/1990 | Grantom | 166/75.1 |
| 5,725,193 | A | | 3/1998 | Adams | 248/523 |
| 5,975,484 | A | | 11/1999 | Brugman et al. | 251/1.3 |
| 6,039,115 | A | | 3/2000 | Mills | 166/68.5 |
| 6,095,241 | A | | 8/2000 | Bland et al. | 166/68.5 |
| 6,223,819 | B1 | * | 5/2001 | Heinomen | 166/85.4 |
| 6,289,986 | B1 | * | 9/2001 | Wright et al. | 166/66.5 |
| 6,361,251 | B1 | * | 3/2002 | Soltanahmadi et al. | 405/170 |
| 6,394,186 | B1 | * | 5/2002 | Whitelaw et al. | 166/349 |

FOREIGN PATENT DOCUMENTS

| | | | |
|---|---|---|---|
| CA | 2 303 983 | 10/2000 | E21B/47/04 |
| CA | 2 349 988 | 10/2001 | E21B/33/03 |
| CA | 2 311 036 | 12/2001 | F04B/47/02 |

OTHER PUBLICATIONS

USSN Patent Application Publication, Vern A. Hult, Publication No.: US 2001/0050168A1, Publication Date: Dec. 13, 2001, Pump Drive Head with Stuffing Box, Application No.: 09/878,465, Application Filed: Jun. 11, 2001.

PCT International Search Report from International Application No. PCT/GB01/04905, dated Apr. 25, 2002.

* cited by examiner

*Primary Examiner*—David Bagnell
*Assistant Examiner*—Zakiya Walker
(74) *Attorney, Agent, or Firm*—Moser, Patterson & Sheridan, L.L.P.

(57) ABSTRACT

An apparatus and method is provided which holds a rod or tubular within a well, allowing a well service provider or operator to safely and more cost effectively disassemble, remove, or otherwise work on a drive assembly. In one aspect, the apparatus comprises an annular body having at least one radial aperture formed therethrough and at least one rod holder disposed through each aperture. The rod holder comprises a push jaw disposed on a first end of a screw. In one aspect, the method comprises shutting down a drive assembly and supporting a rod or tubular with an annular body comprising at least one radial aperture formed there-through, at least one threaded member disposed within the aperture, and at least one push jaw disposed on a first end of the threaded member.

26 Claims, 3 Drawing Sheets

FIG. 1
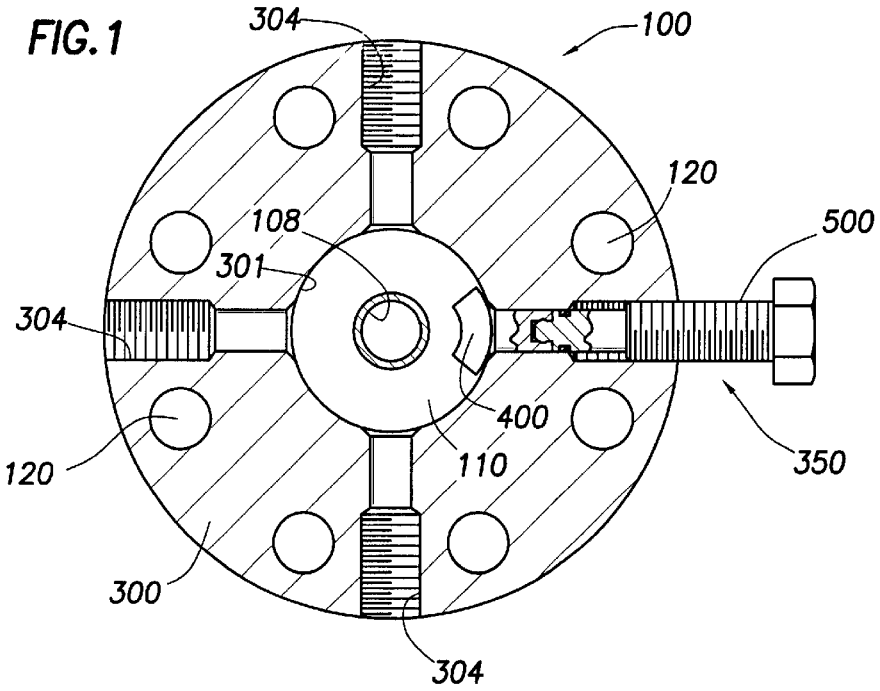
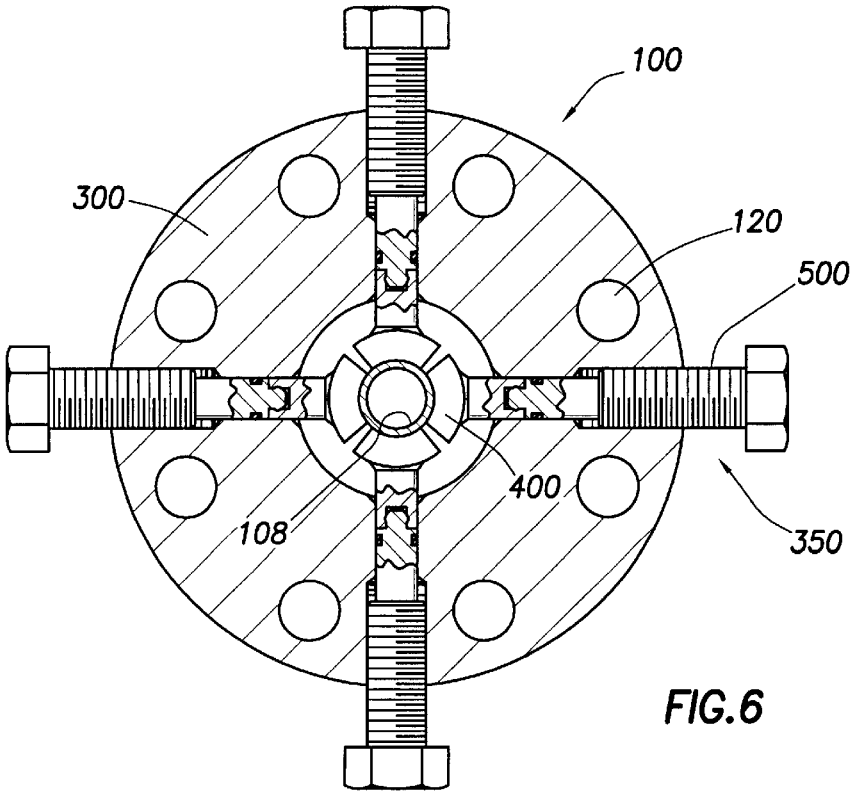
FIG. 6

ROD HANGER AND CLAMP ASSEMBLY

BACKGROUND OF THE INVENTION

1. Field of the Invention

The present invention relates to a wellhead component for holding and supporting the weight of a downhole rod or tubular. More particularly, the present invention relates to a clamping device to hold and support the weight of a downhole rod to facilitate the removal or repair of a surface drive assembly.

2. Background of the Related Art

Oil and gas in newly discovered reservoirs usually flow to the surface by natural lift. The natural formation pressure of a reservoir provides the energy or driving force to move reservoir fluids horizontally into a wellbore, through production tubing, and through surface processing equipment. During the life of any producing well, however, the natural reservoir pressure decreases as reservoir fluids are removed from the formation. As the natural downhole pressure drops to the sum of the hydrostatic head in the wellbore and the facility pressure, the fluids cease to spontaneously flow to the surface. Therefore, artificial lift methods such as sucker-rod pumping, downhole pumping, and gas injection lift techniques, for example, are employed to lift the fluids to the surface.

Many wells today use a downhole pumping apparatus such as a progressing cavity pump (PCP) system to lift fluids from within the production well to the surface. A PCP system consists of a progressing cavity pump located within the wellbore and a motor-driven drive assembly located at the surface of the well. The pump and the motor are connected by a rod string disposed within the production tubing. The progressing cavity pump consists of a rotor disposed within a stator located within the production tubing. The rotor is driven by the rod string which is supported and rotated by the motor-driven drive assembly. The well is produced by rotating the rod string which drives the rotor of the pump resulting in a non-pulsating positive displacement flow of fluids toward the surface of the well.

A problem occurs when the drive assembly requires routine servicing or maintenance after a period of use. Typically, when servicing an assembly, the motor is first shut down and the rod string is allowed to backspin. The rod string is much like a rubber band or other elongated elastic member due to its length. As a result, the rod string possesses accumulated potential energy due to the continuous twisting motion created by the drive motor. The accumulated "winding up" converts into kinetic energy once the drive motor is released or removed. Consequently, the rod string unwinds by rotating in an opposite direction.

Even after the rod string has stopped back-spinning upon the initial shutdown, a sudden jerk or bump to the drive or rod string itself may release residual energy retained in the system and cause the rod string to uncontrollably back-spin. This presents a safety risk to the personnel standing on the wellhead trying to disconnect the drive from the rod string. Also, the spinning rod may damage other equipment nearby.

One method to safely remove a drive assembly from a rod string is to independently hold and support the weight of the rod string prior to removing the drive. Presently, the rod string is clamped to a rig which is secured to a vehicle. Once the rod string has been supported by the vehicle, a second vehicle is typically used to lift and remove the drive assembly from the supported rod string. These steps are then repeated in reverse order to re-connect the drive to the rod string. This method is complex, costly, and time consuming.

Therefore, there is a need for a method and apparatus to facilitate the servicing and/or replacement of progressing count pump components. There is a further need for holding and supporting the weight of a rod string to facilitate an efficient and safe removal of a drive assembly from the rod string.

SUMMARY OF THE INVENTION

A rod hanger and clamp is provided to hold a rod or tubular within a well, allowing a well service provider or operator to safely and more cost effectively disassemble, remove, or otherwise work on a drive assembly. In one aspect, the rod hanger and clamp comprises an annular body having at least one radial aperture formed there-through and a rod holder disposed through each aperture. The rod holder comprises a push jaw disposed on a first end of a threaded member. A well service provider or operator may apply a torque to the threaded member to urge the push jaw against an outer surface of a tubular disposed within a well, thereby holding the tubular in place.

In another aspect the invention provides a method of holding and supporting a tubular within a wellbore comprising shutting down a drive assembly, allowing the tubular to back-spin, and supporting the tubular with an annular body having at least one radial aperture formed therethrough and, at least one threaded member disposed within the aperture. The threaded member has a push jaw to secure the tubular.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a cross section of a rod hanger and clamp of the present invention.

FIG. 6 is a cross section of the rod hanger and clamp in an activated position having a rod or tubing string secured therein.

DETAILED DESCRIPTION OF THE PREFERRED EMBODIMENT

Figure 2:
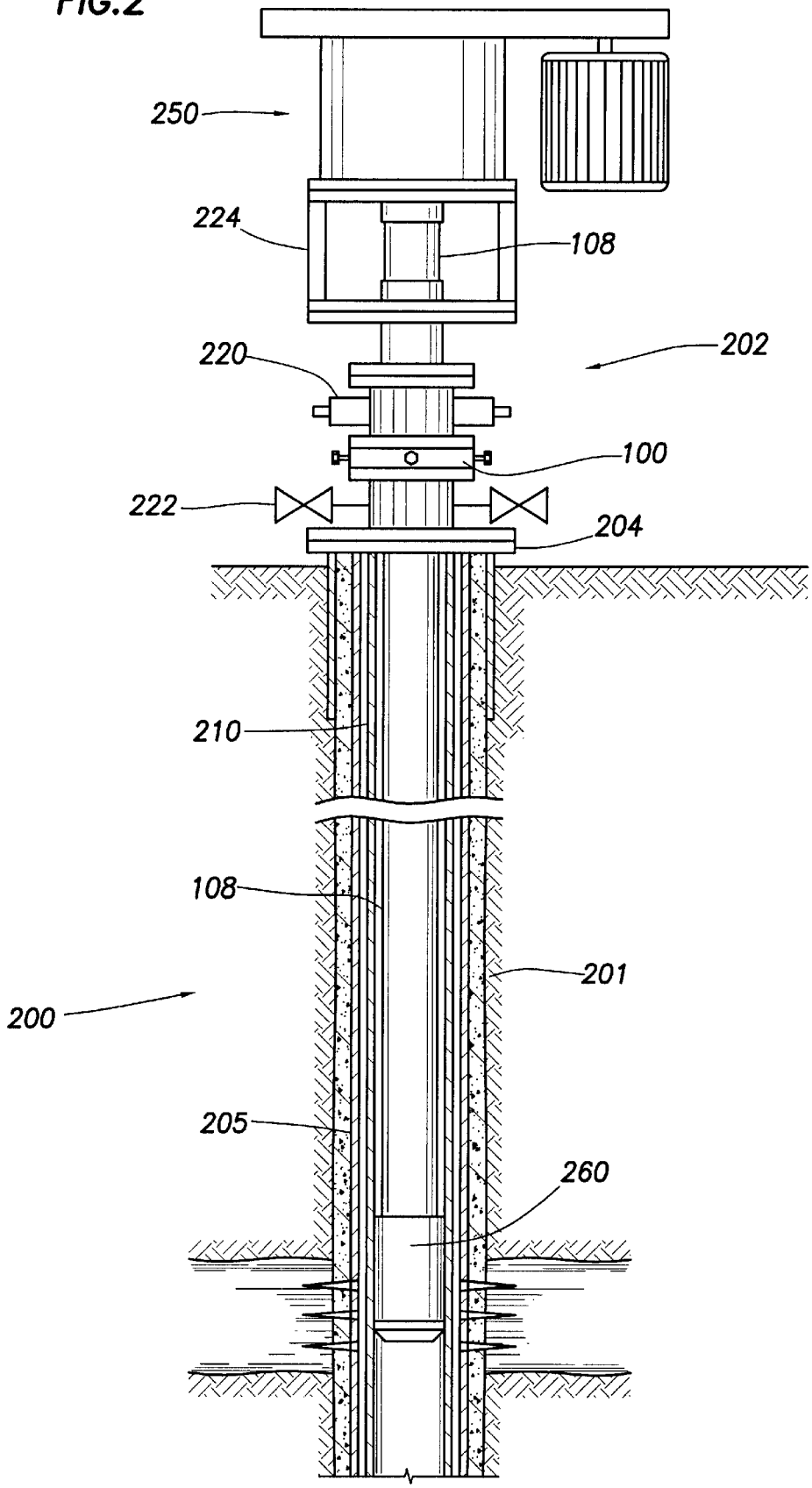
FIG. 2 is a schematic view of a rod hanger and clamp of the present invention in use with a progressing cavity pump artificial lift system disposed within a wellbore.

FIG. 1 is a cross section view of a rod hanger and clamp 100 according to one aspect of the invention. The rod hanger and clamp 100 may be used to hold, retain, and support any rod, rod string, or tubular extending into a wellbore. For clarity and ease of description, however, the rod hanger and clamp 100 will be further described as it relates to a rod string 108 in an artificial lift operation such as progressing cavity pumping (PCP).

The rod hanger and clamp 100 comprises an annular body 300 having one or more radially extending apertures 304 formed there-through. Each radial aperture 304 houses a rod holder 350 which engages an outer surface of rod 108 disposed within the annular body 300. An annulus 110 is formed between an inner surface 301 of the body 300 and an outer surface of the rod 108. The rod holder 350 includes a push jaw 400 disposed at an end of a partially threaded member 500. The annular body 300 also includes a plurality of vertical apertures 120 formed there-through to house a screw or bolt (not shown) which may be used to fasten the rod hanger and clamp 100 within a stack of wellhead components such as those illustrated in FIG. 2.

FIG. 2 is a schematic view of a well 200 having a possessive cavity pump 260 disposed within a wellbore 201. The rod hanger and clamp 100 is disposed within a stack 202 of wellhead components. The stack 202 typically includes a casing head 204 which is mounted at the surface of the well to a casing string 205 which lines the wellbore 201. The stack 202 also typically includes a blowout preventer 220, a production tee 222, which may be integral with the blowout preventer 220, and a stuffing box 224. The stuffing box 224 serves to seal around the rod 108 where the rod 108 is inserted into the well 200, and is known to those skilled in the art.

A drive assembly 250 for a downhole PCP 260 is disposed at the top of the stack 202, and is typically disposed directly on top of the stuffing box 224. The rod hanger and clamp 100 of the present invention is preferably disposed below the drive assembly 250 and above the production tee 222. The rod 108 is run through the wellhead and into the wellbore 200 through a pathway which extends through each of the components 202 of the wellhead stack. The weight of the rod 108 is supported by the drive assembly 250. The PCP 260 consists of a rotor disposed within a stator and is disposed below the surface within production tubing 210. The rotor is driven by the rod 108 which is supported and rotated by the drive assembly 250. During production, the drive assembly 250 rotates the rod 108 which drives the rotor of the pump 260 resulting in a non-pulsating positive displacement flow of fluids toward the surface of the well 200.

Figure 3:
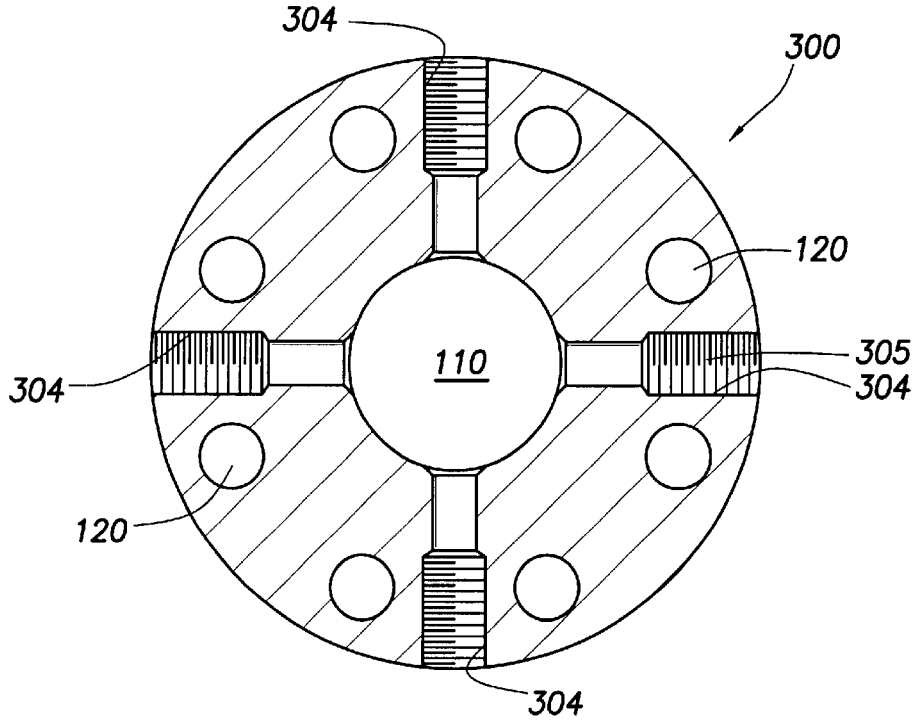
FIG. 3 is a partial cross section of an annular body of the rod hanger and clamp.

FIG. 3 is a partial cross section of the annular body 300 of the rod hanger and clamp 100, wherein the rod holders 350 are not shown so that the plurality of equally spaced radial apertures 304 are clearly visible. The apertures 304 have an at least partially threaded inner surface 305 to engage an outer surface of a threaded member 500.

Figure 4:
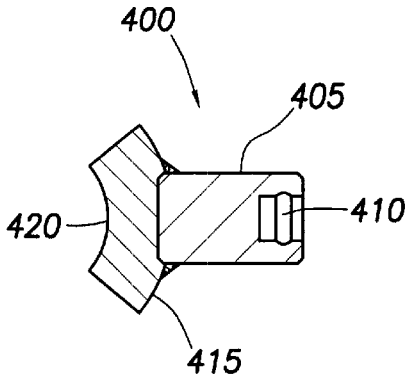
FIG. 4 is a cross section of a rod holder push jaw.

FIG. 4 is a cross section view of the push jaw 400. The push jaw 400 comprises a first portion 405 having a female snap connect 410 at the end thereof for attachment to a threaded member 500. The push jaw 400 further comprises a second portion 415 having an outer surface 420 which substantially conforms to an outer surface of the rod 108 (not shown) extending from the wellbore. For example, the outer surface 420 of the push jaw 400 may be configured to substantially conform to a rod 108 having a round or polygonal outer surface. The outer surface 420 of the push jaw 400 may also include teeth or serrations to better grip and hold the outer surface of the rod 108.

Figure 5:
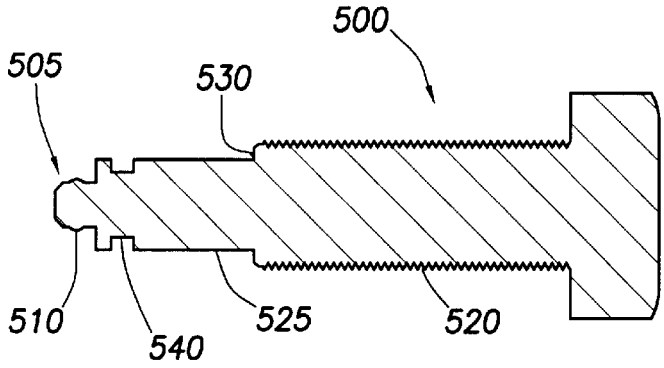
FIG. 5 is a cross section of a threaded member.

FIG. 5 is a cross section of the threaded member 500. The threaded member 500 comprises a first end 505 having a male snap connect 510 which is insertable within the female snap connect 410 of the push jaw 400. The threaded member 500 also comprises a threaded section 520 and a non-threaded section 525. The threaded section 520 has a larger circumference or outer diameter than the non-threaded section 525. The different outer diameters 520, 525 form a shoulder 530 between the threaded 520 and non-threaded sections 525. The shoulder 530 acts as a stop to prevent the threaded member 500 from over-advancing within the aperture 304 of the annular body 300. The threaded member 500 further includes a recessed groove 540 disposed in an outer surface thereof between the first end 505 and the non-threaded section 525 of the threaded member 500. An O-ring (not shown) or any other known means for sealing can be used with the groove 540 to provide a fluid-tight seal around the threaded member 500.

In operation, the drive assembly 250 is first shut-down or turned off. The rod 108 is then allowed to back-spin, releasing most built-up rotational stress within the rod 108. Torque is thereafter applied to the rod holders 350 to advance the rod holders 350 within the apertures 304. The threaded members 500 are advanced until a predetermined force is applied to the rod 108. Specifically, as the rod holders 350 advance toward the center of the annular body 300, the push jaws 400 that are attached to the first ends 505 of the rod holders 350, engage the outer surface of the rod 108 thereby holding the rod 108 in place. The rod 108 is then held both rotationally and axially within the wellbore 201.

FIG. 6 shows a cross section of an actuated rod hanger and clamp 100. As shown, the rod holders 350 have advanced within the apertures 304 engaging the curved surface 420 of the push jaw 400 against the outer surface of the rod 108. Once engaged, the weight of the rod 108 is independently held and supported by the rod hanger and clamp 100 so that the drive assembly 250 may be removed and serviced.

While foregoing is directed to the preferred embodiment of the present invention, other and further embodiments of the invention may be devised without departing from the basic scope thereof, and the scope thereof is determined by the claims that follow.

What is claimed is:

1. A rod hanger and clamp assembly, comprising:

an annular body disposable around a rod having at least one radial aperture formed there-through, wherein the at least one radial aperture comprises a first threaded inner diameter that is larger than a second non-threaded inner diameter and a shoulder;

at least one rod holder disposable through the at least one radial aperture, the at least one rod holder having a first threaded outer diameter for mating with the first threaded inner diameter of the at least one radial aperture and a stop formed on the outer diameter to prevent axial movement of the at least one rod holder within the at least one radial aperture; and a retaining member removably disposed on one end of the at least one rod holder, whereby the at least one rod holder is adjustable within the at least one aperture for applying a predetermined radial force on the rod and thereby supporting a weight of the rod when the predetermined force is applied.

2. The rod hanger and clamp assembly of claim 1, wherein the at least one radial aperture includes a partially threaded inner surface and the at least one rod holder includes a partially threaded outer surface.

3. The rod hanger and clamp assembly of claim 1, wherein the retaining member comprises a push jaw.

4. The rod hanger and clamp assembly of claim 3, wherein the push jaw includes a first end which substantially conforms to an outer surface of the rod.

5. The rod hanger and clamp assembly of claim 4, wherein radial advancement of the at least one rod holder urges the first end of the push jaw against the outer surface of the rod.

6. The rod hanger and clamp assembly of claim 4, wherein the rod is held and supported by the rod hanger and clamp assembly.

7. The rod hanger and clamp assembly of claim 1, wherein the annular body has four radial apertures and four rod holders disposable therein.

8. The rod hanger and clamp assembly of claim 1, wherein the at least one rod holder comprises a non-threaded first outer surface and a threaded second outer surface.

9. The rod hanger and clamp assembly of claim 8, wherein the threaded second outer surface of the at least one rod holder engages a threaded inner surface of the at least one aperture.

10. The rod hanger and clamp assembly of claim 1, further comprising at least one vertical aperture formed within the annular body for attaching the rod hanger and clamp assembly within a stack of wellbore components.

11. The rod hanger and clamp assembly of claim 1, wherein the annular body is disposed within a stack of wellbore components below a motor-driven drive assembly.

12. The rod hanger and clamp assembly of claim 1, wherein the annular body is disposed about the rod.

13. The rod hanger and clamp assembly of claim 1, wherein the at least one rod holder comprises a groove.

14. The rod hanger and clamp assembly of claim 1, wherein the at least one rod holder comprises a second outer diameter smaller than the first threaded outer diameter.

15. The rod hanger and clamp assembly of claim 1, wherein the rod comprises a tubular.

16. The rod hanger and clamp assembly of claim 1, wherein the stop is constructed and arranged to mate with the shoulder.

17. A rod hanger and clamp assembly for use with a drive assembly, comprising:

an annular body disposed below the drive assembly, the annular body having at least one aperture formed there-through, wherein the at least one radial aperture comprises a first threaded inner diameter that is larger than a second non-threaded inner diameter;

at least one threaded member disposed within the at least one aperture, the at least one threaded member engaging the first threaded inner diameter of the at least one aperture; and at least one push jaw disposed on a first end of the at least one threaded member, wherein the rod hanger and clamp assembly is capable of holding and supporting a rod.

18. The rod hanger and clamp assembly of claim 17, wherein the at least one threaded member has an at least partially non-threaded outer surface.

19. The rod hanger and clamp assembly of claim 17, wherein the at least one push jaw comprises a first end which substantially conforms to an outer surface of the rod that is disposed through the annular body.

20. The rod hanger and clamp assembly of claim 19, wherein radial advancement of the at least one threaded member forces the first end of the at least one push jaw against the outer surface of the rod thereby holding and supporting the rod.

21. A method of holding and supporting a rod within a wellbore, comprising:

shutting down a motor-driven drive assembly;

allowing the rod to back-spin; and supporting the rod with an annular body comprising:

at least one radial aperture formed there-through;

at least one threaded member disposed within the at least one aperture; and at least one push jaw disposed on a first end of the at least one threaded member, wherein the rod is supported by applying a radial force to the rod.

22. The method of claim 21, wherein the annular body is disposed on a wellhead between a wellhead casing flange and the motor-driven drive assembly.

23. The method of claim 21, wherein rotation of the at least one threaded member forces a first end of the at least one push jaw against an outer surface of the rod thereby holding and supporting the rod.

24. A method of holding and supporting a rod within a wellbore, comprising:

shutting down a rod drive assembly; and supporting the rod with an annular body comprising:

at least one radial aperture formed there-through, wherein the at least one radial aperture comprises a first threaded inner diameter that is larger than a second non-threaded inner diameter;

at least one threaded member disposed within the at least one aperture, wherein the at least one threaded member is arranged to mate with the first threaded inner diameter of the at least one aperture; and at least one push jaw disposed on a first end of the at least one threaded member, wherein the rod is held and supported by applying a radial force to the rod.

25. The method of claim 24, wherein rotation of the at least one threaded member forces a first end of the at least one push jaw against an outer surface of the rod thereby holding and supporting the rod.

26. The method of claim 24, wherein the annular body prevents torsional spin of the rod.

* * * * *